United States Patent [19]

Thibault

[11] 3,961,653

[45] June 8, 1976

[54] LOOM WEFT POSITIONER

[75] Inventor: Harrison N. Thibault, Hopedale, Mass.

[73] Assignee: Rockwell International Corporation, Pittsburgh, Pa.

[22] Filed: May 14, 1975

[21] Appl. No.: 577,299

[52] U.S. Cl. ..... 139/450

[51] Int. Cl.[2] ..... D03D 47/34

[58] Field of Search ..... 133/122 R, 122 H, 122 W, 133/127 R, 194, 195, 116

[56] References Cited

UNITED STATES PATENTS

| | | | |
|---|---|---|---|
| 2,665,716 | 1/1954 | Budzyna et al. | 139/127 R |
| 3,396,755 | 8/1968 | Nichols et al. | 139/122 H |
| 3,431,951 | 3/1969 | Thibault et al. | 139/122 R |
| 3,455,340 | 7/1969 | Golobart | 139/122 H |
| 3,587,662 | 6/1971 | Remond | 139/122 H |

FOREIGN PATENTS OR APPLICATIONS

| | | | |
|---|---|---|---|
| 484,887 | 10/1929 | Germany | 139/194 |

*Primary Examiner*—James Kee Chi

[57] ABSTRACT

A weft yarn positioner device for shuttleless looms having a weft engaging member pivotably attached to one end of a depressor arm which by cam controlled linkage moves the weft engaging member in a pathway to engage and present each pick of weft to the means for its insertion into sheds of warp threads. The weft engaging member being pivotably attached to the depressor arm is effective in yielding in a direction, after reception by its insertion means and under tension of the weft, which releases the weft from contact with the weft engaging member.

3 Claims, 3 Drawing Figures

Fig. 1
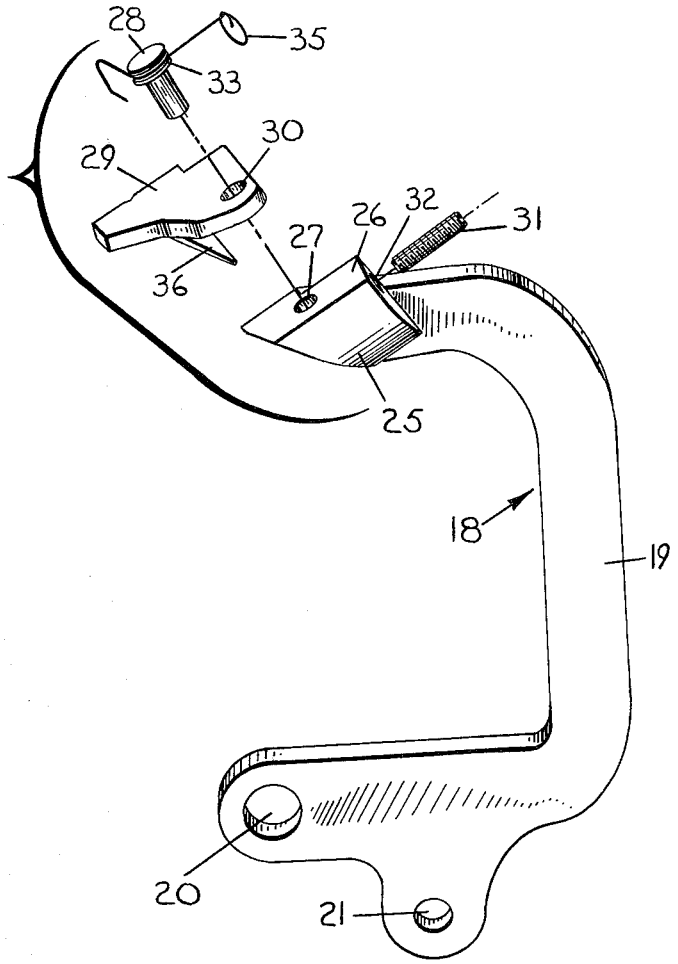
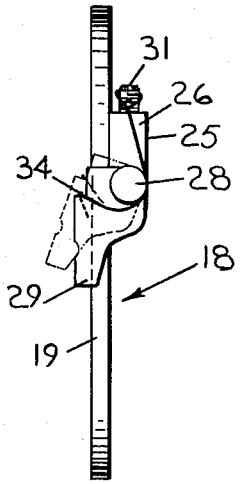
Fig. 3
Fig. 2
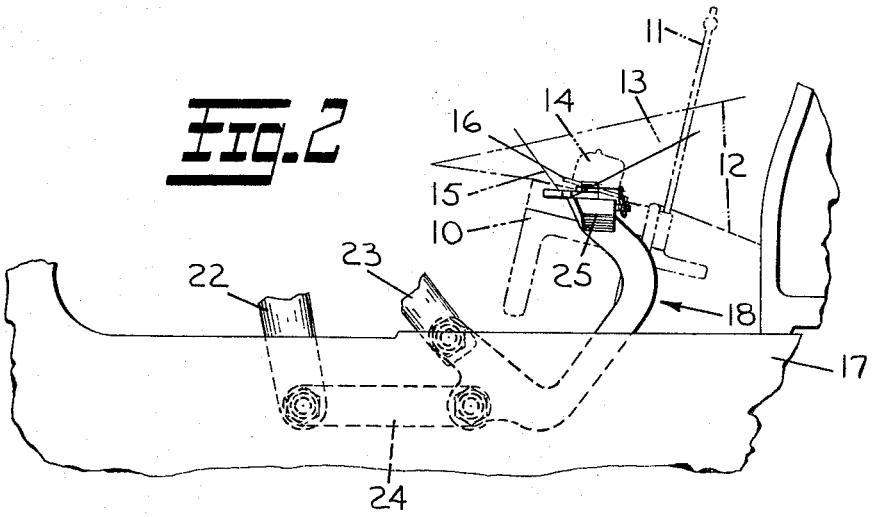

LOOM WEFT POSITIONER

BACKGROUND OF THE INVENTION

1. Field of the Invention

In shuttleless looms which utilize weft yarn that is furnished from an outside source and is not carried to and fro through the shed by the shuttle or carrier itself, it is common practice to insert each pick of weft by two reciprocating elements. That element which introduces the weft into the warp shed is known as the inserting carrier and that which receives or has transferred to it the introduced weft to be drawn through the remainder of the shed is known as the weft receiving or extending carrier. The invention is more specifically devoted to an improved means for presenting the weft to the inserting carrier and controlling its release from the presenting means as inserted, especially in looms of the type in which weft is presented to the inserting means to be laid in connected pairs of individual picks frequently termed "hairpins." For this type of shuttleless loom the general mode of operation of the weft control apparatus is generally understood by those skilled in the art and specific means therefor is disclosed by the teachings of U.S. Pat. No. 2,604,123.

2. Description of the Prior Art

In shuttleless looms to which the present invention is applicable the weft yarn is drawn from a stationary source of supply and through an eyelet provided in and adjacent the free end of a so-called weft positioner arm. With the weft yarn being inserted into sheds in the form of interconnected pairs of picks and each length of pick being in a separate shed, the positioner arm is caused to swing to and fro in a known manner between so-called first and second pick positions. In each of the first and second pick position a portion of the weft is located at a common point which is within the pathway of a weft depressor. During loom operation the weft depressor is continually moving in a vertical plane and forms somewhat of an elliptical path. As the depressor moves downwardly from its uppermost position it is adapted to engage the weft and move it to a lower position where it is received by the inserting carrier which then inserts it into the warp shed.

The known form of weft depressor is provided with an integrally formed weft engaging hook from which the weft yarn must be shed or pulled as the inserting carrier carries the weft yarn into the warp shed. As the carrier moves toward the shed and before the weft has had an opportunity to slide off or be shed from the tip or hook portion of the depressor the pulling of the weft by the carrier will cause said weft to wrap around the forward surface of said hook portion. This has created a very serious and unsatisfactory condition when weaving with certain types of weft yarns. Soft and low twist yarns, for example, will frequently break while in the process of being shed or pulled off the tip of the depressor as the inserting carrier is moving toward the warp shed.

The loom weft positioner comprising the invention has overcome the problem described above by providing a weft depressor having a tip or weft engaging hook portion that is yieldable in the direction in which the weft yarn is normally pulled therefrom.

SUMMARY OF THE INVENTION

The loom weft positioner for shuttleless looms of the present invention includes a depressor arm of conventional configuration having the usual cam controlled linkage members operatively associated with the lower end thereof for moving said arm in a vertical plane during the performance of its intended function. In place of the usual upper tip or weft engaging hook, the upper end of the depressor arm has a weft engaging member pivotally attached thereto which includes a biasing means for continuously urging said engaging member to a position for receiving the weft and moving the same to that position for reception by the inserting carrier. After pick-up of the weft by the inserting carrier and as the latter moves toward the shed, its pull on the weft is sufficient to cause the weft engaging member to pivot or yield in the direction said weft is being pulled so that the latter is readily shed from said engaging member.

It is a general object of the invention to provide a weft depressor for shuttleless looms which will readily shed the weft therefrom after presenting it for pick-up by the inserting carrier.

Another object is that of providing a yielding type weft depressor which is relatively inexpensive to manufacture and which will perform its function effectively on all types of weft yarn.

These and other objects of the present invention will become more fully apparent by reference to the appended claims and as the following detailed description proceeds in reference to the figures of drawing wherein:

BRIEF DESCRIPTION OF THE DRAWING

FIG. 1 is a perspective view in exploded form showing in detail the elements which comprise the invention;

FIG. 2 is a view in side elevation showing a portion of a shuttleless loom and the device according to the invention applied thereto, and FIG. 3 is a view in front elevation of the device in FIG. 1 and by means of dotted lines the position to which the weft engaging member is caused to move to shed the weft held thereby.

DESCRIPTION OF THE PREFERRED EMBODIMENT

As the general construction and operation of a shuttleless loom's weft yarn mechanism is known and familiar to those conversant in the weaving art and as the invention is entirely concerned with a weft positioner or so-called weft depressor for use with such a mechanism, it is only considered necessary here to illustrate and describe that portion of the mechanism directly concerned with a preferred form of the invention.

Now referring to FIG. 2 of the drawing a portion of a shuttleless loom is illustrated including a lay beam 10 having a reed 11 supported thereon and through which warp yarns 12 extend in the usual manner. A conventional harness mechanism (not shown) sheds the warp yarns 12 to form shed openings 13 into which a carrier member 14 is caused to enter for inserting a length of weft yarn 15. The carrier 14 shown in FIG. 2 is fixed to the end of a flexible tape 16 which by means not shown is caused to be wrapped about and unwrapped from an oscillating tape wheel mounted on the side frame 17 of the loom.

The loom weft positioner comprising the invention is indicated generally by numeral 18 and includes the usual substantially U-shaped depressor arm 19 having apertures 20 and 21 (FIG. 1) on the lower end thereof. These apertures serve as a means of connecting the depressor arm 19 to cam controlled linkages 22, 23 and 24 (FIG. 2) which are effective in a known manner in continually moving the depressor arm in a vertical plane which defines a generally elliptical pathway.

The opposite or upper end of the depressor arm 19 (FIGS. 1 and 2) terminates in a boss 25 having a planar surface 26 in which a hole 27 is provided for reception of the shank portion of a stud 28. A weft engaging member 29 of generally triangular configuration having a hole 30 located adjacent one corner thereof pivotably attaches to the planar surface 26 by means of stud 28 passing through said hole 30 and into hole 27. Stud 28 is anchored in hole 27 by means of an elongated set screw 31 that assembles in a threaded hole 32 provided in the side of the boss 25 and which communicates with hole 27.

A torsion type spring 33 continually urges the weft engaging member 29 to the solid line position shown in FIG. 3 whereat it is in position for engaging and moving the weft to a position for pick-up by the inserting carrier. This spring assembles on stud 28 as shown in FIG. 3 and has one end thereof in operative engagement with the side of the weft engaging member 29 as at 34 and the opposite end which is in the form of a loop 35 is retained by the outer end of the elongated set screw 31. To prevent movement of the weft engaging member 29 beyond the solid line position in FIG. 3, said member is provided with an integrally formed and depending finger 36 (FIG. 1) which is adapted to engage the side of the boss 25 formed on the upper end of the depressor arm 19.

To summarize the operation the depressor arm 19, during loom operation, is continually moving in a vertical plane and forms somewhat of an elliptical path as the inserting carrier is projected into and withdrawn from the shed of warp threads. During the carrier's initial movement toward the shed the depressor arm 19 is caused to move downwardly and during this movement the weft engaging member 29 engages the weft and draws the same downwardly to a position where it will enter the inserting carrier. As the carrier continues to move toward the shed and carry the weft with it, the pulling force of the carrier on the weft will cause the weft engaging member 29 to pivot to the dotted line position shown in FIG. 3. In this dotted line position the weft being held by member 29 is quickly shed therefrom and the possibility of its being wrapped about the end thereof or broken is prevented.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In a shuttleless loom of the type having an external stationary weft supply source, reciprocable carrier means for inserting picks of weft from said source into sheds of warp threads, a weft control member comprising:

a. a depressor arm;

b. a weft engaging member;

c. means mounting said weft engaging member on said depressor arm, said means providing for movement of said weft engaging member to release the weft after its engagement by the carrier means; and d. cam controlled linkage members operatively connected to said depressor arm for moving the latter in a path to cause said weft engaging member to engage each pick of weft and present it to the carrier means.

2. The weft control member according to claim 1 wherein said mounting means includes a pin member fixed to said depressor arm on which said weft engaging member is pivotably carried.

3. The weft control member according to claim 1 wherein said member includes a biasing means carried on said mounting means and operatively connecting said depressor arm with said weft engaging member for continuously urging the latter to its weft engaging position.

* * * * *